United States Patent [19]

Hammel

[11] Patent Number: 4,991,614

[45] Date of Patent: Feb. 12, 1991

[54] METHOD AND A PLANT FOR TRANSPORT OF HYDROCARBONS OVER A LONG DISTANCE FROM AN OFFSHORE SOURCE OF HYDROCARBONS

[75] Inventor: Bent Hammel, Eiksmarka, Norway

[73] Assignee: Kvaerner Engineering A/S, Lysaker, Norway

[21] Appl. No.: 438,412

[22] PCT Filed: Jun. 22, 1988

[86] PCT No.: PCT/NO88/00056

§ 371 Date: Dec. 7, 1989

§ 102(e) Date: Dec. 7, 1989

[87] PCT Pub. No.: WO88/10397

PCT Pub. Date: Dec. 29, 1988

[30] Foreign Application Priority Data

Jun. 25, 1987 [NO] Norway ..... 872666

[51] Int. Cl.[5] ..... F17D 1/17

[52] U.S. Cl. ..... 137/13; 137/571

[58] Field of Search ..... 137/1, 3, 13, 571

[56] References Cited

U.S. PATENT DOCUMENTS 4,725,287 2/1988 Gregoli ..... 137/13

*Primary Examiner*—Alan Cohan

*Attorney, Agent, or Firm*—Nixon & Vanderhye

[57] ABSTRACT

A method is disclosed for transport of hydrocarbons in a pipeline flow across large distances, from a first location at an offshore hydrocarbon reservoir to a second location. At said first location a liquid absorbent is provided in the form of a gas-poor hydrocarbon liquid flow. A flow of gas saturated hydrocarbon liquid and released associated hydrocarbon gas is supplied to the gas-poor liquid flow at first location, the volume of gas-poor hydrocarbon liquid being selected so as to be sufficient for all released associated hydrocarbon gas to be absorbed by the gas-poor hydrocarbon liquid. Then the hydrocarbon liquid with absorbed hydrocarbon gas is transported to said second location. A plant for transport of hydrocarbons in a pipeline flow is also disclosed. The plant comprises an absorption chamber (6) at a first location. Absorption chamber (6) is connected to a well pipe (3). At a second location a separator plant (9) is provided. A first pipeline extends from the liquid portion of separator plant (9) to absorption chamber (6). A second pipeline (7) connects absorption chamber (6) with separator plant (9). In said first pipeline (10) the flowing medium can be pressurized by the aid of a high pressure pump (11).

5 Claims, 2 Drawing Sheets

Figure 1:
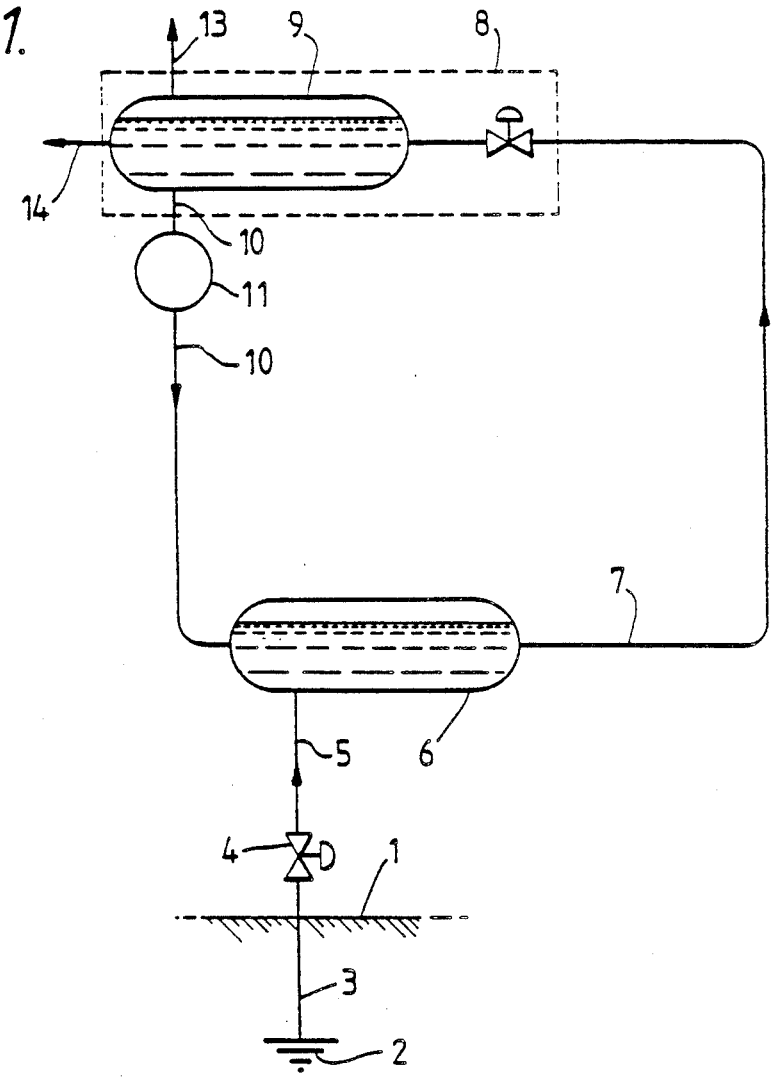

METHOD AND A PLANT FOR TRANSPORT OF HYDROCARBONS OVER A LONG DISTANCE FROM AN OFFSHORE SOURCE OF HYDROCARBONS

The present invention relates to a method for transport of hydrocarbons from an offshore source of hydrocarbons over long distances, as stated in the preamble of the independent method claim.

The invention also relates to a plant for such transport of hydrocarbons, as stated in the preamble of the independent device claim.

The invention, in fact, relates to a method with the aim of rendering possible transport of hydrocarbon liquid (oil) and hydrocarbon gas (gas) through one and the same pipeline over long distances in connection with offshore oil and gas production.

Offshore oil and gas production today is commonly carried out as follows:

Production wells are drilled from a platform into the reservoir. The platform is placed above wave tops on a support standing on the sea floor or floating on the surface of the sea The wellhead valves closing the reservoir pressure are provided on the platform, commonly straight above production wells.

The oil being highly pressurized in the hydrocarbon reservoir contains large volumes of dissolved gas. The capability of the oil to retain dissolved gas decreases with dropping pressure and rising temperature. When oil flows up from a reservoir through the production well and the well head valve on the platform causing a pressure drop gas is, thus, released from oil. What appears after the well head valve is, thus, a mixture of oil and gas.

This mixture of oil and gas is supplied to a processing plant which is generally located on the platform. The functions of such a processing plant essentially are separation of oil and gas and rendering oil suitable for transport and gas suitable for transport or return to the reservoir.

Since such processing requires power and hydrocarbons are flammable a series of auxiliary functions and emergency systems must be provided around the processing plant. Operation of processing, auxiliary, and emergency systems, furthermore, requires operators who, in turn, require quartering and a series of other functions. Plants,.thus, tend to be large and expensive both as regards investments and operation. The expense problem is enhanced at greater depth of the sea when the platform with plant has to be supported by an expensive stationary or floating basis.

Great development projects are running at present with the object of cost reduction. Among others, technology was developed which permits well head valves to be located on the sea floor—so called subsea production plants. This is of considerable economic importance because the number of rigs necessary for draining a hydrocarbon reservoir may be reduced. A subsea production plant is located above an area of the hydrocarbon reservoir that cannot be reached by the aid of production wells from a platform.

Production wells of a subsea production plant are drilled from floating or jackup drilling vessels. Oil and gas from the hydrocarbon reservoir flows up and past well head valves on the sea floor, and then passes as a two-phase flow (oil and gas in a mixture) in a pipeline connecting the subsea production plant with the platform. Such two-phase flows cause formation of slugs of liquid involving heavy liquid knocking, uncontrolled flowing conditions, and considerable pressure drop in the pipeline. The distance between the subsea production plant and the platform, thus, must not be large. At present, a practical limit is assumed to be approximately 15 kilometers.

Technical concepts to increase said distance will have a great economical potential. In its utmost consequence the platform may then become redundant, since well head valves may be placed on the sea floor close to the hydrocarbon reservoir, and processing, auxiliary, and emergency systems may be provided on the shore.

Large development projects are in progress these days in order to solve the problem of transporting oil/-gas mixtures over large distances. Some of these projects aim at supplying pressure to the oil/gas mixture by placing two-phase pumps on the sea floor to compensate for the great pressure drop. Other projects aim at separating oil and gas on the sea floor and then pumping oil and gas to a processing plant through separate pipelines.

The mentioned concepts involve considerable technical problems since much advanced technical equipment must be placed on the sea floor.

Reduced reliability and safety cannot be accepted

It is an object of the invention to render possible transport of oil and gas in one and the same pipeline over large distances. A more specific object of the invention is to permit transport of the oil/gas mixture from a subsea production plant to en processing plan on land without the necessity of first conducting the oil/-gas mixture up onto a platform.

The invention is based on the same phenomenon which, in the first place, creates the problem, viz. the varying capability of oil to absorb gas dependent on pressure and temperature. The inventive concept is,.-thus, to supply oil which has been crocessed to become gas-poor and is, thus, capable of absorbing gas, from the processing plant on the shore to the subsea production plant in a pipeline, and then to mix this gas-poor oil with oil and gas arriving from the reservoir via the subsea production plant. The gas-poor oil acts as an absorbent which absorbs gas. Gas-poor oil is supplied to the subsea production plant at a pressure which is adapted to the pressure prevailing after the well head valve. The volume of gas-poor oil supplied to the subsea production plant is adapted to the demand for gas absorption.

According to the invention a method is, thus, provided as stated in the independent method claim with features as stated in the characterizing part of the independent method claim.

As mentioned, the invention also relates to a plant for transport of hydrocarbons as stated in the independent device claim and with features as stated in the characterizing part of said claim.

Further features of the invention will appear from the dependent claims.

Figure 4:
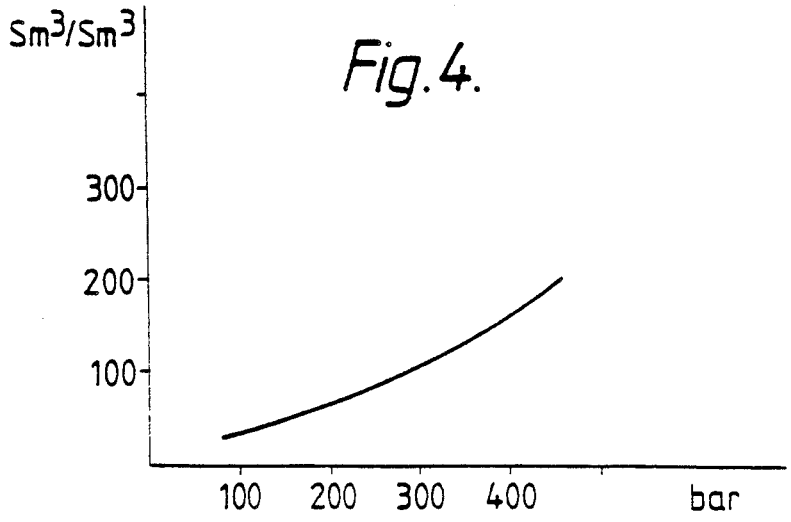
Figure 2:
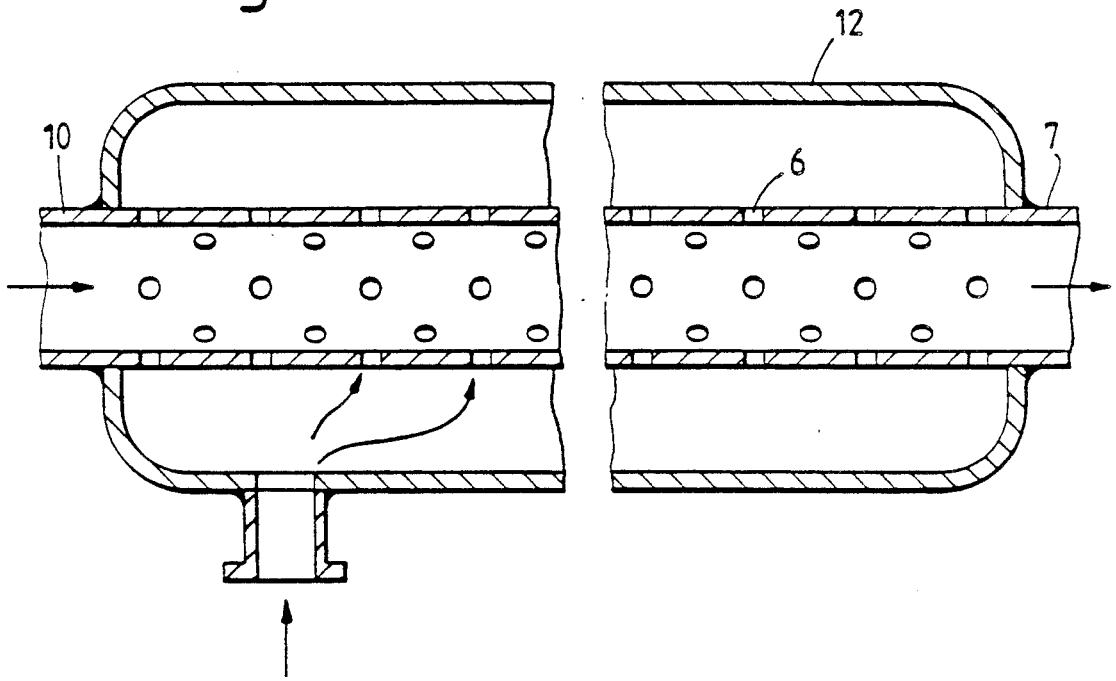
Figure 3:
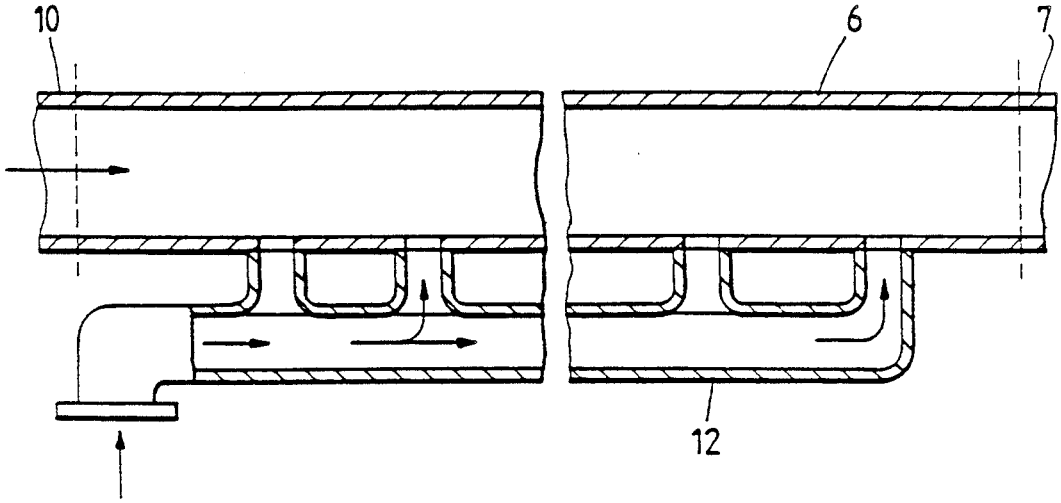

The invention is disclosed in more detail below with reference to the drawings, where FIG. 1 diagrammatically shows a plant according to the invention, FIGS. 2 and 3 show embodiments of absorption chambers that may be used in the plant of FIG. 1, and FIG. 4 shows a graph of the ability of absorbing gas dependent on pressure of a kind of oil of interest.

In FIG. 1 a hydrocarbon reservoir under the sea floor 1 is designated 2. From the hydrocarbon reservoir well tubing 3 extends to a well head valve 4. From well head valve 4 a pipeline 5 extends to an absorption chamber 6 which is preferably placed on the sea floor. From absorption chamber 6 a pipeline 7 extends to a plant 8 on land. The latter plant, among others, comprises a separator plant 9 connected to pipeline 7. From separator plant 9 a pipeline 10 extends back to absorption chamber 6. In pipeline 10 a high pressure pump 11 is provided.

As an example, it may be assumed that hydrocarbon reservoir 2 is located 100 km from land at a depth of 150 m. The pressure in such a reservoir is 460 bar. The oil in the reservoir is gas saturated.

FIG. 4 shows the capability of dissolving gas at various pressures of an oil type of interest It appears that saturated oil contains approximately 210 standard $m^3$ of gas at 460 bar.

During transport to well head valve 4 pressure will drop to e.g. 200 bar before reaching the well head valve. The pressure in the oil/gas is further choked down across the well head valve 4 and will be 70 bar after the valve. At this pressure a standard $m^3$ oil saturated with gas can only contain 21 standard $m^3$ of gas. The remaining gas, i.e. 210 minus 21=189 standard $m^3$/standard $m^3$ oil will be liberated and flows with oil in a two-phase flow at a pressure of 70 bar.

From the land based plant 8, i.e. from separator plant 9, gas-poor oil is pumped by the aid of high pressure pump 11 through the 100 km long pipeline 10 to the subsea production plant, i.e. to absorption chamber 6 of the plant. Pump 11 (if desired, several pumps) is dimensioned for a pressure of 70 bar at the subsea production plant. In this connection it will be necessary to consider the slope from the shore down to a water depth of 150 m, as well as the pressure loss when gas-poor oil flows through the pipeline.

At 70 bar a standard $m^3$ of oil can absorb 21 standard $m^3$ of gas. There will, thus, be needed 189:21=9 standard $m^3$ of gas-poor oil from the shore in order to absorb the gas that was liberated after the well head valve 4 from one standard $m^3$ of oil from the reservoir 2. If gas-poor oil is, thus, supplied from the shore of the order of ten times the oil flowing from the reservoir, all gas in the mixture will be absorbed by the oil, and the mixture will flow as a pure liquid flow in return pipeline 7 towards land.

Pipeline 7 towards land, however, extends uphill. Additionally, there is a flow loss in the pipeline. There will, thus, be a pressure drop. The oil will then again release gas with the problems resulting from a two-phase flow. To avoid these problems it will be necessary to increase the volume of gaspoor oil supplied from the shore through pipeline 10 to ensure sufficient capacity of the oil to hold all gas until the oil arrives back at the land based plant after passing through the 100 km long pipeline 7.

Friction losses in the pipelines can be estimated at 26.5 bar either way. The pipeline also extends uphill for 150 m, which corresponds to a pressure drop of approximately 13.5 bar in the oil. Since the pressure was 70 bar at the subsea production plant and the total pressure loss is 40 bar in the return section, pressure in pipeline 7 at the shore will be 30 bar. At said pressure one standard $m^3$ of oil can only hold 10 standard $m^3$ of gas. This means, that if 210 minus 10=200:10=20 times as much gas-poor oil is supplied from the shore as oil produced from the reservoir the gas-poor oil from the shore will absorb all released gas from the reservoir and the mixture can be transported through pipeline 7 back to the shore without the pressure drop in the pipeline causing release of gas on the way.

According to the invention gas-poor oil is, thus, supplied to act as an absorbent to gas in a pipeline loop from land to the subsea production plant and back. The volume of gas-poor oil in this concrete example would be 20 times the volume of oil produced from the reservoir. At the subsea production plant the oil/gas flow from reservoir 2 is introduced to the gas-poor oil flow in absorption chamber 6, where all gas is completely absorbed, since the volume of gas in the oil will be sufficiently below gas saturation point of the oil. As the undersaturated oil gets closer to land (in pipeline 7) it will also approach the point of gas saturation.

If reservoir 2 has an assumed productivity of 400 standard $m^3$ per hour it is, thus, necessary to supply 20 times 400=8000 standard $m^2$/hour or 2.2 standard $m^3$/second gas-poor oil from the shore. In the return section the liquid flow will be 2.3 standard $m^3$/second since 400 standard $m^3$/hour of reservoir oil is also taken along.

At a velocity of flow in the pipeline of 2.3 m/second a pipe cross section of 1 $m^2$ or a pipeline with a diameter of 1.13 m will be required. Such a pipeline can be laid from land out to the subsea production plant, and back by the aid of known laying methods.

The invention benefits from an important fact, viz. that there is a surprisingly small difference in costs for laying a pipeline with a large diameter in relation to a pipeline with a small diameter. Costs will mainly depend on expenses in connection with the lay vessel which is needed for both pipe sizes. For both pipelines, i.e. one with a large diameter, and one with a small diameter, respectively, laying costs will be in the order of NOK 12000/meter.

Investment costs for a plant without a platform as compared to a plant with a platform can be calculated as follows:

| | Plant with platform billions ($10^9$) NOK | Plant without platform billions ($10^9$) NOK |
|---|---|---|
| Production wells (12) | 1.2 | 1.2 |
| Subsea production plant | — | 0.5 |
| Pipeline to shore 100 000 m · 12000 | 1.2 | 1.2 |
| Pipeline from shore | — | 1.2 |
| Platform with basis | 5.0 | — |
| Processing plant on land | — | 1.0 |
| Supply of gas-poor oil to pipeline | — | 0.2 |
| | 7.4 | 5.3 |

Operating costs for the conventional plant will be approximately 0.55 billions ($10^9$) NOK a year. For plants without platforms operating costs will be considerably lower.

The advantages of plants without platforms will increase substantially for larger depths of the sea.

The figures of the example show that the process to render oil/gas transportable and which conventionally occurs in the processing plant on the platform may be, in an economically advantageous manner, replaced by another, simpler process based on gas absorption in liquid, which process may be carried out in a simple plant on the sea floor. A platform, however, has also other important functions. Such functions are receiving and launching plant for pigs
control of well drilling valves, and
injection of water or gas into the hydrocarbon reservoirs.

Receiving and launching plants for pigs may be placed on land if the diameter of pipeline 10 from the shore to the subsea production plant equals the diameter of return pipeline 7. Pigs can then be sent through the pipeline loop from the shore and back to the shore. The area at the subsea production plant where gas absorption occurs must then be designed so as to prevent obstacles to the pigs. Two different embodiments of the absorption chamber permitting this are shown in FIGS. 2 and 3. Pipelines 10 and 7 have the same diameter and are connected by absorption chamber 6 which has the same internal diameter. A manifold 12 spreads oil and gas from the hydrocarbon reservoir in the absorption chamber to provide for best possible absorption.

Control of the well head valves can be achieved from land with present technology. Such technology is known to those skilled in the Art.

Injection of water or gas into the hydrocarbon reservoir in order to increase the degree of recovery from the reservoir may be carried out from land by the aid of a separate pipeline to the subsea production plant. Such a pipeline would involve costs of NOK 1.2 billion ($10^9$) and additional costs for processing plant and pump for water to be injected.

By the present invention a method is, thus, provided for transport of associated hydrocarbon gas and hydrocarbon liquid in a pipeline over long distances. What characterizes the method is that gas-poor hydrocarbon liquid acting as an absorbent to gas is pressurized in a high pressure pump, and that gas-poor hydrocarbon liquid under high pressure is fed in a pipeline to an absorption chamber at the hydrocarbon reservoir, and that gas saturated hydrocarbon liquid and released associated hydrocarbon gas from the hydrocarbon reservoir are also introduced into said absorption chamber, the volume of gas-poor hydrocarbon liquid being large enough to permit all released associated hydrocarbon gas from the reservoir to be absorbed by the gas-poor and gas absorbing hydrocarbon liquid. The hydrocarbon liquid with absorbed hydrocarbon gas is fed through a pipeline from the absorption chamber to a separation plant. There, hydrocarbon gas is separated from the hydrocarbon liquid to make the latter gas-poor. Part of the gas-poor hydrocarbon liquid is returned to the high pressure pump to be recirculated once more.

From separator plant 9 separated associated hydrocarbon gas is removed through pipeline 13, whereas gas-poor hydrocarbon liquid is removed through a pipeline 14. Removal naturally, occurs in such a manner that the plant is in required balance all the time.

Above, the invention was disclosed in more detail in connection with a hydrocarbon reservoir. Generally, the invention, however, concerns transport from a hydrocarbon source that may be a subterranean hydrocarbon reservoir or another source of gas saturated hydrocarbon liquid.

I claim:

1. A method for transporting hydrocarbons in a pipeline over long distances, from a first location at an offshore hydrocarbon source to a second location, comprising the steps of providing, at the first location, an absorbent including a gas-poor hydrocarbon liquid, supplying a flow of gas saturated hydrocarbon liquid and released associated hydrocarbon gas from the hydrocarbon source to said gas poor hydrocarbon liquid adjacent said first location, the volume of gas-poor hydrocarbon liquid being selected to be large enough to permit all released associated hydrocarbon gas to be absorbed by said gas-poor hydrocarbon liquid, flowing said hydrocarbon liquid with absorbed hydrocarbon gas to said second location, separating the hydrocarbon gas from said hydrocarbon liquid with absorbed hydrocarbon gas at said second location to provide said gas-poor hydrocarbon liquid flow that is supplied at said first location.

2. A method as defined in claim 1, including pressurizing said gas-poor hydrocarbon liquid to high pressure in a high pressure pump, feeding said gas-poor hydrocarbon liquid under high pressure to an absorption chamber adjacent said hydrocarbon source, introducing said gas saturated hydrocarbon liquid and released associated hydrocarbon gas from said hydrocarbon source into said absorption chamber, feeding said hydrocarbon liquid with absorbed hydrocarbon gas from said absorption chamber to a separator plant, separating said hydrocarbon gas from said hydrocarbon liquid in said separator plant to make hydrocarbon liquid gas-poor, and returning part of said gas-poor hydrocarbon liquid to said high pressure pump.

3. A plant for use in transporting hydrocarbons in a pipeline flow across long distances, from a first location at an offshore hydrocarbon source to a second location, comprising an absorption chamber at said first location and connected to the hydrocarbon source, a separator plant at said second location for separating hydrocarbon gas from hydrocarbon liquid to produce a gas-poor hydrocarbon liquid, a first pipeline for flowing at least part of the gas-poor hydrocarbon liquid from said separator plant to said absorption chamber, and a second pipeline for flowing the hydrocarbon liquid with absorbed hydrocarbon gas from said absorption chamber to the separator plant, and means for pressurizing the gas-poor hydrocarbon liquid in said first pipeline.

4. A plant as defined in claim 3, wherein both pipelines have the same internal diameter.

5. A plant as defined in claim 3, wherein said absorption chamber is tube-shaped with the same internal diameter as said first and second pipelines and is connected to said pipelines.

* * * * *